US005938325A

United States Patent [19]

Edwards

[11] Patent Number: 5,938,325

[45] Date of Patent: Aug. 17, 1999

[54] STIRRING ROD WITH FLEXIBLE EXTENSIONS FOR MIXING MATERIALS

[76] Inventor: Ron J. Edwards, 7329 10th St., Rio Linda, Calif. 95673

[21] Appl. No.: 09/157,786

[22] Filed: Sep. 21, 1998

Related U.S. Application Data

[60] Provisional application No. 60/064,166, Nov. 4, 1997.

[51] Int. Cl.[6] ..... B01F 7/16

[52] U.S. Cl. ..... 366/129; 366/325.6; 366/326.1; 416/231 A; 416/240

[58] Field of Search ..... 366/64–67, 96–98, 366/102–104, 242–252, 279, 129, 325.6, 326.1, 342, 343, 605; 99/323.5, 348; 416/132 R, 227 R, 231 A, 240, 241 A

[56] References Cited

U.S. PATENT DOCUMENTS

| | | | |
|---|---|---|---|
| 820,405 | 5/1906 | Dunlap | 366/326.1 |
| 1,159,080 | 11/1915 | Poggensee | 366/326.1 |
| 1,426,080 | 8/1922 | Holt | 366/129 |
| 1,438,716 | 12/1922 | Orzchovski | 366/129 |
| 1,475,081 | 11/1923 | Parks | 366/326.1 |
| 1,646,858 | 10/1927 | Grossenbacher | 366/325.6 |
| 1,744,445 | 1/1930 | Casey | 366/129 |
| 1,826,356 | 10/1931 | Mahony | 366/129 |
| 2,243,443 | 5/1941 | Sette | 366/129 |
| 2,278,398 | 3/1942 | Wittmann | 366/343 |
| 2,546,285 | 3/1951 | Wittmann | 366/129 |
| 2,670,938 | 3/1954 | Wittmann | 366/343 |
| 2,778,615 | 1/1957 | Hahn | 416/240 |
| 2,799,485 | 7/1957 | Silverman | 366/326.1 |
| 3,128,083 | 4/1964 | Blair | 366/326.1 |
| 3,215,410 | 11/1965 | McMaster et al. . | |
| 3,328,005 | 6/1967 | McMaster et al. | 416/241 A |
| 3,619,081 | 11/1971 | Gruska et al. | 416/240 |
| 5,037,210 | 8/1991 | Bliss | 366/343 |
| 5,163,357 | 11/1992 | Felknor et al. | 99/323.5 |

*Primary Examiner*—Charles E. Cooley

[57] ABSTRACT

An elongate rod having a first end or end area and an oppositely disposed second end or end area, the first end suitably structured for connecting to a rotary drive such as the chuck of a hand held drill type motor, food blender drive or the like for example, and the second end area including attached flexible line members extending generally perpendicular to the length of the elongate rod. In a preferred embodiment, the flexible line members are made of resilient plastics material such as lawn and weed trimmer type line. Additionally preferred is the line members being retained such that they extend on one side of the rod at a slight angle downward to extend below the terminal end of the second end of the rod for allowing stirring against a container bottom surface, and extend on an opposite side of the rod at a slight angle upward for allowing stirring against a container top surface or lid. The flexible line members are preferably removably connected to the rod via frictionally tight insertion through receiving hole(s) in the rod. The flexible line members are preferably non-round in cross sectional width, and the receiving holes are preferably round in diameter.

15 Claims, 5 Drawing Sheets

STIRRING ROD WITH FLEXIBLE EXTENSIONS FOR MIXING MATERIALS

A priority claim is hereby made to my Provisional Application filed Nov. 4, 1997 application No. 60/064,166 for the common material.

BACKGROUND OF THE INVENTION

1. Field of the Invention

The present invention relates to stirring rods and like devices used to stir or mix materials such as paints, stains, lacquers, inks, dry powders, granular materials, foodstuffs, feasible combinations thereof, and the like. The present invention is a stirring rod which is structured to be engaged with a rotary drive such as a motor rotary drive so that the stirrer is rotated in the material to be mixed or stirred.

2. Description of the related Prior Art

While there are several related prior art stirring rods currently available for purchase in the market place, none are structured the same as the present invention, and none offer all of the advantages and benefits of the present invention. Some of the significant problems or shortcomings existing in related prior art stirring rods include: (1) the inability of the stirring rod to fit through a small hole such as a bunghole in a drum or like container and still have an adequately large head or long lateral reach at the stirring head to adequately and quickly mix the materials; (2) the inability to scrape or stir directly against the interior bottom surface of a container, or the underside surface of a top or lid on the container holding the material to be mixed; (3) the inability to scrape or stir directly against the interior sidewall of a container of the material to be mixed, and further without damaging the container sidewall, bottom or lid; (4) safety, as many prior art stirring rods include hard flanges or blades which could injure a person (or the container) coming in contact with the rotating flanges; (5) durability and cost of manufacture, as many prior art stirring rods are costly to manufacture and costly or unfeasible to repair when worn or damaged; and, (6) ease in cleaning the stirring rod after use, as many prior art stirrers are difficult or time consuming to clean.

The present invention overcomes all of the above and additional shortcomings of the related prior art.

SUMMARY OF THE INVENTION

The present invention is a stirrer or stirring rod for use in stirring or mixing materials. The materials may be paints, stains, lacquers, inks, dry powders, granular materials, foodstuffs, feasible combinations thereof, and the like. The present stirring rod is structured to be engaged with a rotary drive such as that of a motor drive so that the rotary drive rotates the present stirrer with a stirring end thereof inserted into the material to be mixed or stirred. The stirring end of the invention includes flexible (bendable) stirring extensions preferably made of flexible and resilient plastics and which can be defined with elongate small diameter plastic line such as lawn and weed trimmer line commonly used with motorized weed trimmers for trimming vegetation.

As will become fully appreciated with continued reading, the present stirrer or stirring rod overcomes many shortcomings of prior art stirrers including the six shortcomings hereinabove listed in reference to prior art stirrers.

DESCRIPTION OF THE PREFERRED EMBODIMENTS

The following detailed description is of preferred embodiments given for example with specific reference to the drawings, and although there are changes which could be made to that which is specifically herein described and shown, for the sake of brevity of this disclosure, all of the changes which do fall within the scope of the present invention have not herein been detailed, but will become apparent to those skilled in the art with a study of this disclosure.

Figure 1:
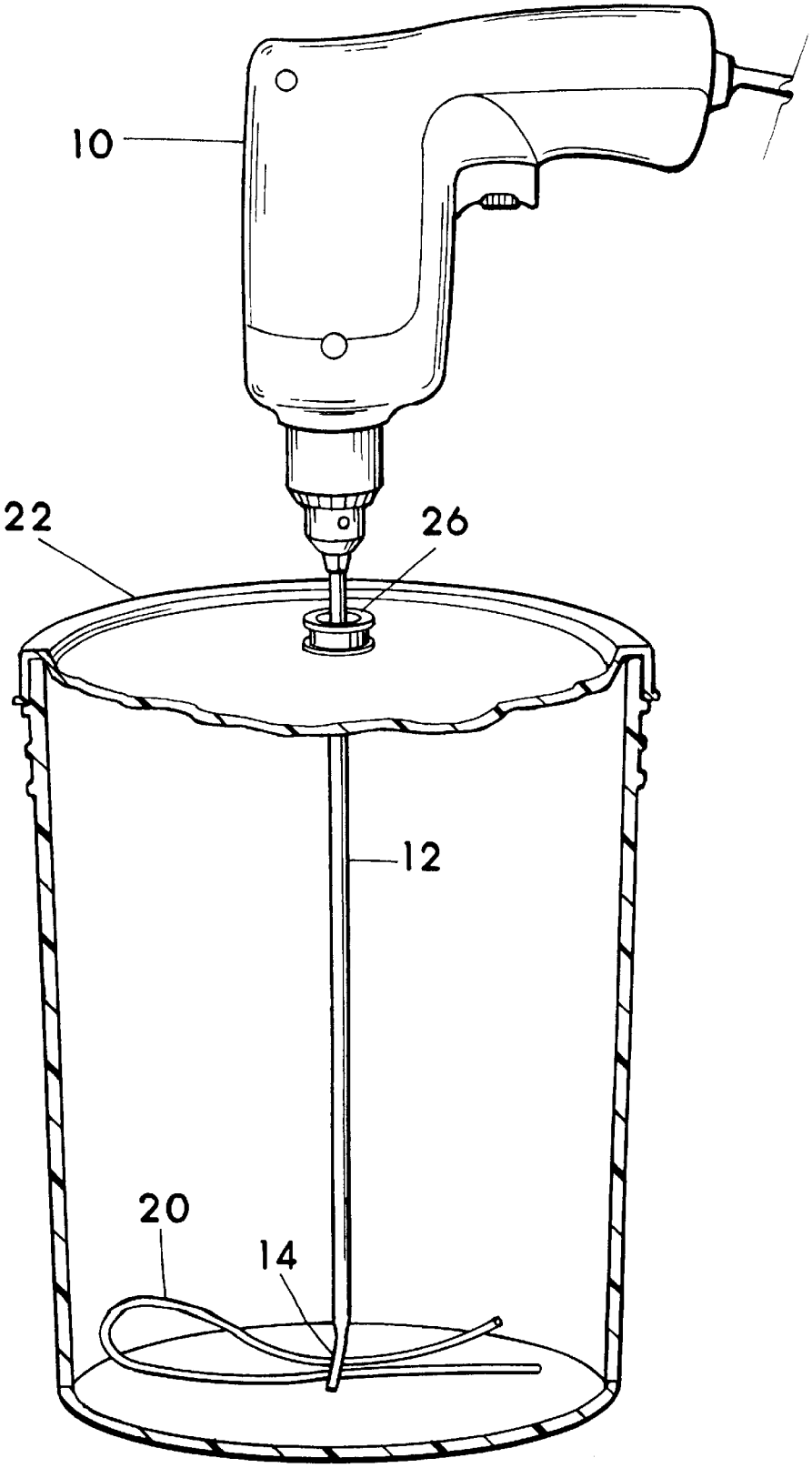
FIG. 1 is an illustration showing a stirring rod in accordance with the present invention in use stirring materials in a bucket (container) having a top lid with small diameter bunghole. A cut-away of the bucket is provided for illustrative purposes. A hand-held style drill motor with holding chuck is shown driving (rotating) the stirring rod. The flexible stirring extension members are shown in this drawing near the bottom of the bucket.
Figure 4:
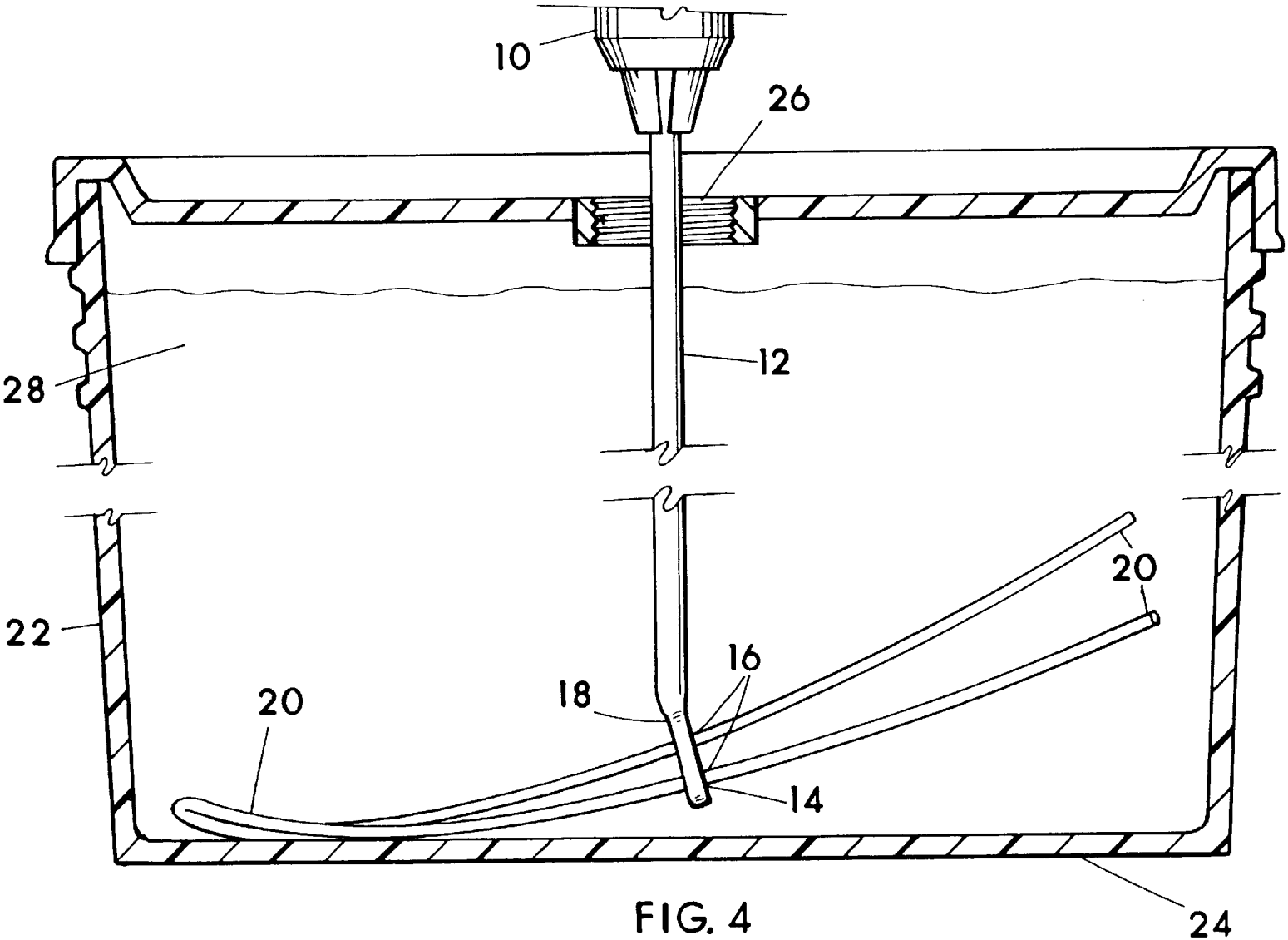
FIG. 4 is a view illustrating a container full of liquid material such as paint, the container shown in a side view with cut-away to allow viewing inside, and a stirring rod in accordance with the present invention inserted through the container top bunghole opening and in use stirring the paint. The flexible stirring extensions are shown in this drawing retained at an angle relative to the lengthwise axis of the main rod which is shown connected at its upper end to a rotary drive.

The present invention is an inexpensive and highly effective stirring rod and is intended to be used to stir or mix materials such as paints, stains, lacquers, inks, liquids of just about any type, dry powders, granular materials, pastes, foodstuffs, feasible combinations thereof and the like. The present stirring rod in most cases will be lightweight and readily transported by hand such as from one container to the next, or from one job site to the next. The present stirring rod is intended to be engaged with and supported by a rotary drive such as that of an electric motor, pneumatic or hydraulic motor so that the motor axially rotates the stirrer in the material to be mixed or stirred, as such rotation provides for faster more efficient stirring compared to simply moving the stirrer back and forth through the material absent rotation. A hand crank or manually powered rotary drive connected to the present stirrer could also be utilized. The connection of the present stirrer to a suitable rotary drive is preferably a removable connection for ease in storing, transporting, repair and the like reasons, although a permanent connection while not preferred would be acceptable. In FIG. 1, a small hand-held type electric drill style motor 10 is shown driving (rotating) the stirring rod. A rotatable openable and closeable chuck (clamp) of the motor 10 is shown in FIG. 4. The chuck is rotated by the motor, and thus rotates the present stirrer when connected thereto.

The present invention includes an elongate main rod 12 which is of fairly stiff construction and generally non-bendable during intended use, although some flexing in rod 12 during use is tolerable. Rod 12 being an elongated rod or shaft includes a first end or first end area and a second end or second end area oppositely disposed from the first end. The first end or top end of rod 12 is sized sufficiently small in cross section to be inserted or otherwise attached to a rotary drive such as the chuck of a drive motor 10 used to rotate the stirrer rod as shown in FIG. 1. The sizing and shaping of the rod first end can be widely varied within the scope of the invention, however, with typical hand-held electric drill style motors and associated chucks, the first end of rod 12 can simply be circular in cross section and sized sufficiently small to fit into the chuck of the drill motor 10, which for example, the first end of rod 12 could be simply ¼ inch round stock. One or more flat sides on the first end can also be applied if desired to help prevent rotation of rod 12 relative to the rotary chuck. The first end of rod 12 can be shaped in any appropriate shape to be engagable with the rotary drive such as a mixer head of a foodstuff blender or drive motor to be used to rotate rod 12. Such shapes can include one of more short lateral rigid material extensions such as might be used with twist-to-lock type connections such as are commonly used in association with some food blenders. Threaded engagements could be used where appropriate, as could friction fit connections between the rod 12 first end and the rotary drive, such frictional fits possibly utilizing a spring ball detent mounted to the first end of rod 12.

Rod 12 may be made in any desired useful length, however it should be long enough to allow placing the second end of the rod 12 onto or closely adjacent the bottom of a container or mixing bowl with the drive motor and chuck out of or above the materials to be mixed. Rod 12 will be quite long when manufactured in a version long enough to reach the bottom of a 30 or 55 gallon drum or the like deep container. Shorter versions of rod 12 are more feasible for 1 and 5 gallon containers such as those commonly used to hold paint and the like. The use of couplers and rod-extending pieces to allow user selected lengthening of a short rod 12 would be within the scope of the invention. Rod 12 can be manufactured using numerous materials including steel, plastics structured to provide a relatively stiff rod 12, aluminum, fiber glass, wood, composites and numerous other materials. I have successfully made rod 12 from mild steel round stock and also from plastics round and hex stock both of which are fairly inexpensive and readily available. I have also successfully made rod 12 from fairly flexible plastic rod stock. For weight and cost reasons, I prefer to make rod 12 for stiff plastic rod stock sufficient large in diameter to not require flattening at 14 and bending at 18 as with the small diameter steel rod of FIGS. 2–3. In order to render the present stirring rod "spark-less", rod 12 could be made of aluminum or plastics or the like material not subject to creating sparks or static electricity, so that the stirring rod can be safely used in hazardous conditions such as in a potentially explosive material or environment. Rod 12, when to be used with foodstuffs for human consumption, needs to be made of materials suitable for direct contact with human food, such as stainless steel for example only, likewise line 20, to be detailed below, should also be of material suitable for direct contact with human food when used in such an environment, such as a plastics approved for contact with food.

Rod 12 in the drawings could be made of numerous materials and appear as shown, or it could be made of numerous materials and appear somewhat differently than shown. Rod 12 can be made of round solid steel rod of about ¼ inch diameter for example only and with the first end left round (circular in cross section). Rod 12 for low cost manufacturing is preferably a straight shaft or rod absent curves, bends or cork-screw style spiraling which could add to the cost of manufacturing, however, rod 12 could have small bends or spiraling as indicated in broken lines in FIG. 5 and which are preferably small enough to fit through a small opening or bunghole in a container top and which in certain circumstance may aid in mixing, however, I do not see any significant need for such bends or spiraling in the rod 12.

Although one could manufacture rod 12 from material having a greater diameter or cross sectional width, when manufacturing the present invention with a rod 12 of steel in ¼ inch round stock, in order to have plenty of material for strength purposes on each side of holes 16, holes 16 to be explained later, I prefer to flatten the rod 12 in the areas where holes 16 are to be applied, as this flattening widens the material as may be seen in FIG. 2 and 3 in widened area 14. The flattening at the bottom or second end of rod 12 to define widened area 14 also provides a thin area more readily bent as will become appreciated with continued reading.

Figure 5:
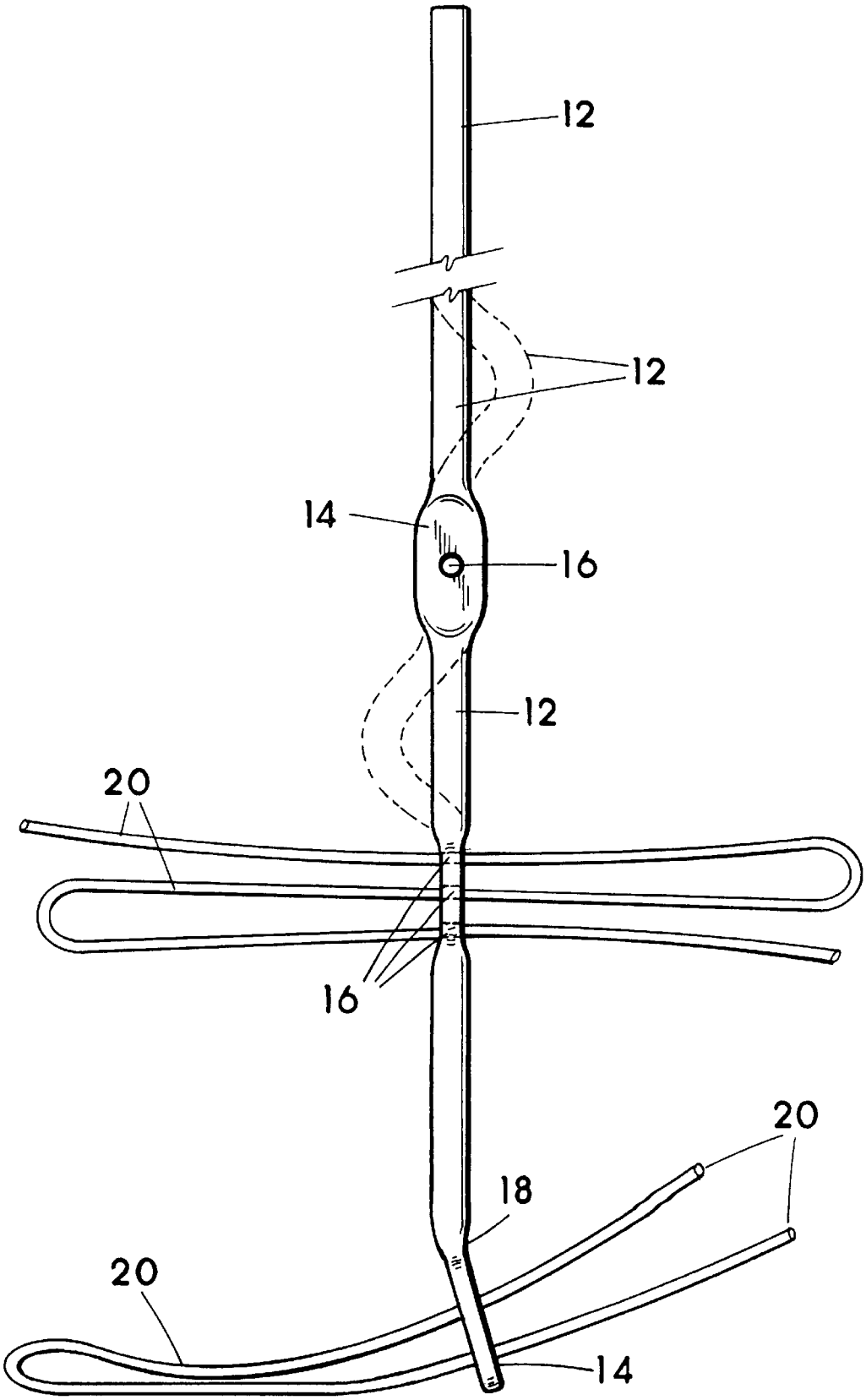
FIG. 5 is a view of a stirring rod in accordance with the present invention, but a varied embodiment from that of FIG. 1 and 4, and shown from what is considered a left side view. Multiple flexible stirring extension members are shown in this drawing in spaced relationship to one another along the length of the main rod. Also shown are broken lines indicating the main rod can include bends and the like to potentially aid in stirring.

As can be ascertained from the drawings, including FIG. 5, rod 12 can have numerous flattened areas 14 along its length, and a particularly long rod 12 such as for deep containers such as 30 or 55 gallons drums or the like is more likely to include multiple flattened areas 14 each having one or more holes 16 therethrough, and this for mixing or agitating at multiple depths in the material at one time. A short rod 12, eighteen or so inches long, such as for a 1, 3 or 5 gallon container will function very well with a single flattened area 14 on the second or bottom end of rod 12 as shown in FIGS. 1–4, although a single flattened area 14 will also function adequately in deep containers within the scope of the invention.

Figure 2:
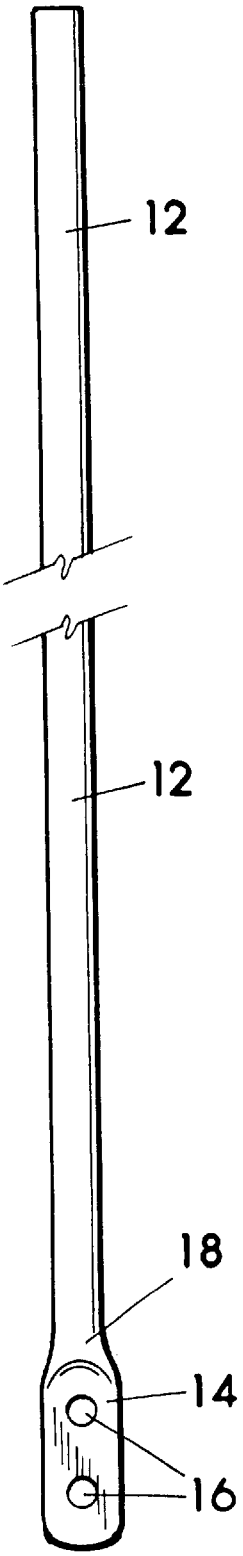
FIG. 2 is a view of a main rod of a stirring rod in accordance with the present invention from what is considered a front side view. The flexible stirring extension members are not shown in this drawing.
Figure 3:
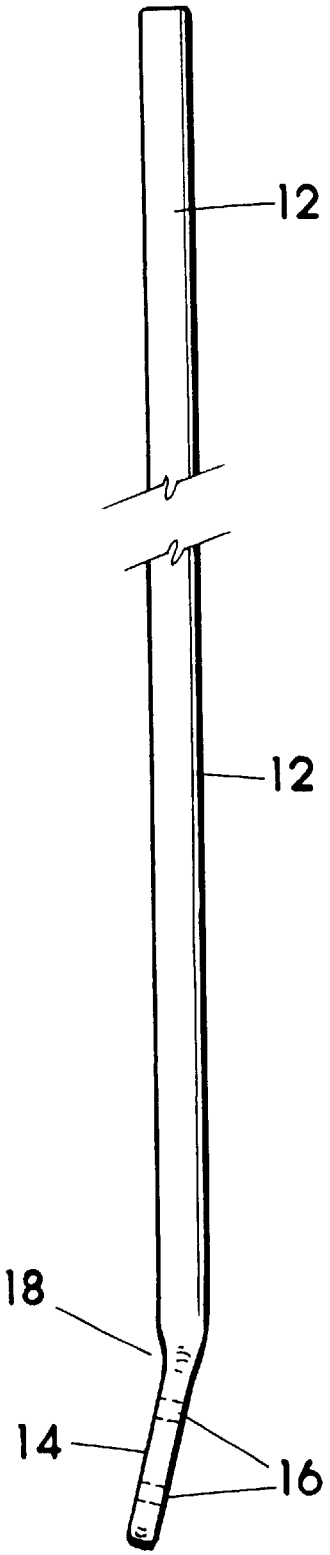
FIG. 3 is a view of the main rod of FIG. 2 rotated 90 degrees to show what is considered a right side view. The flexible stirring extension members are not shown in this drawing.

Holes 16 are applied through flattened area 14, from one flat side to the opposite flat side as shown in FIGS. 2 and 3. The holes 16 may be formed by drilling or punching or any other suitable process such as laser cutting or integrally formed such as might be accomplished if rod 12 is injection molded of plastics or cast of metal. Although holes 16 may be of numerous different sizes within the scope of the invention, I use a #31 American machinist drill bit to form holes 16 through flattened area 14 when making rod 12 from steel or plastics bar stock and when using 0.105 inch diameter flex-line 20 inserted in the holes 16 as will be detailed. Holes 16 are preferably formed in pairs as shown in FIGS. 2 and 3, stacked one above the other rising vertically up the length of rod 12, and this in order to end-up with multiple line 20 extension members on each opposite side of rod 12 as shown in FIG. 4. As may be ascertained from FIG. 5, a single hole 16 with line 20 therein is useful by itself, as are three or more holes 16 in a single area within the scope of the invention. Two holes 16 as a pair as shown in FIG. 2 function quite adequately in most applications. It should be noted the flattening or widened area 14 is not always needed, particularly if there is sufficient rod material for on each lateral strength on each lateral side of holes 16.

Figure 6:
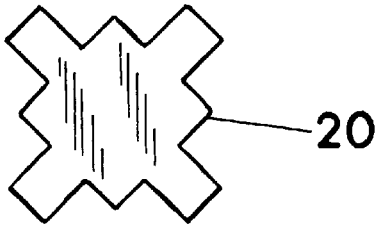
FIG. 6 shows a cross-sectional view of a non-round preferred shape of flexible stirring extension material.
Figure 7:
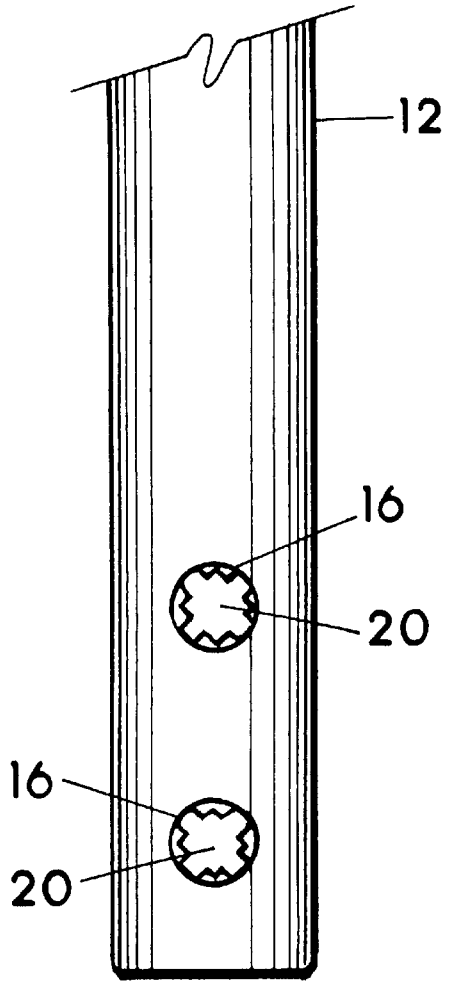
FIG. 7 shows an end of a main rod of a stirrer in accordance with the present invention and varied, i.e., absent a flattened area, from that of FIGS. 1–5. The flexible stirring extension member material of FIG. 6 is shown inserted through holes in the main rod.

The purpose of the hole or holes 16 in these particular examples of structural embodiments in accordance with the invention is to retain a length of flexible stirring extension material or line 20 which may herein be referred to a flexible members. Line 20 (flexible members) are preferably made of flexible and resilient plastics and even more preferably is what is known as "trimmer line" typically used in electric and gasoline powered lawn and weed trimmers. Trimmer line is readily available and inexpensive. Flexible materials or lines other than trimmer line type such as metal cable would be suitable in some applications but would be more expensive and more likely to injure a person coming into contact therewith during rotation. Line 20 should be readily bendable by hand, and this so the flexible members can be readily bent to fit through a small diameter opening such as a bunghole. With holes 16 formed with a #31 drill bit, or formed to an equivalent size, trimmer line of 0.105 inch diameter (cross-section) is used as line 20 (flexible members) inserted through and frictionally retained in holes 16. Preferably, line 20 is of the type which is non-round in cross section, an example of one of several non-round trimmer lines available is shown in FIG. 6 which is a cross width view. Other non-round shapes of line 20 available as trimmer line include shapes which are more triangular in cross-sectional shape than that shown in FIG. 6, and also include compressible or bendable outer points or thin extending flanges. Holes 16 are round holes at least in FIGS. 2 and 7. The use of non-round line 20 allows the flexible and preferably somewhat resilient plastics to be more readily deformed or compressed by the hole 16 into which it is somewhat forcefully inserted, and thus frictionally retained therein. Initially line 20 in the non-round form is manually inserted into a hole 16 which is slightly smaller in diameter than the line 20, and because line 20 in its most preferred form is plastic and non-round, the line 20 can be deformed by the snug fit and drawn through the hole 16 with hand applied force to a desired length extension. The resiliency of the line 20 with it being a snug fit in hole 16 maintains the line 20 stationary within the hole 16 during use, although line 20 can be manually pulled out of holes 16 to allow the ready replacement of the damaged or worn line with new line 20, or for removing the line 20 from rod 12 to clean the rod 12, holes 16 and line 20 separately from one another. Round line 20 would be suitable in some applications, and might best be used if installed through holes in conjunction with oval or otherwise non-round holes 16 in rod 12. FIG. 7 shows line 20 in cross section within holes 16 to illustrate the snug fit aspect. Additionally aiding to hold line 20 in place in holes 16 during high speed rotation is the angled disposition of the holes 16 relative to rod 12 and to the centrifugal force direction against line 20 relative to the angled hole 16. Other structuring to hold line 20 on rod 12 which are not herein shown or described on a rod such as rod 12 and intended to be used as a stirring rod for mixing materials are within the scope of the invention, however, the arrangement of securing line 20 extending generally perpendicular to the length of rod 12 by way of a snug fit between line 20 and holes 16 in rod 12 is a simple and inexpensive arrangement to accomplish the desired structural arrangement for the present stirring rod. As can be seen in FIGS. 1 and 4, a single length of line 20 can be fold in two and the two free ends each inserted through a separate hole 16 defining a loop or bend in line 20 on one side of rod 12 and two free ends of line 20 on the opposite side of rod 12 (or flattened area 14), with this folded arrangement in effect define flexible members on each opposite side of rod 12. Alternatively, as shown in FIG. 5, the looped or folded single length of line 20 can be bent or folded an additional time and inserted through a third hole 16, or alternatively as shown in FIG. 5 a single hole 16 can be used wherein a single straight length of line 20 (not shown installed in hole 16) would be inserted through the single hole to render a free end of the line on each side of rod 12. The arrangement in FIGS. 1 and 4 with a single length of line 20 used with a pair of holes 16 at the bottom or second end of rod 12 is adequate in most applications.

As can be seen such as in FIG. 5 for example, the preferred line 20 includes a degree of stiffness, although it is quite flexible, and includes a degree of resiliency which allows the line to normally stand basically outward, extending outward from rod 12, and thus line 20 when secured to rod 12 defines laterally extending flexible and resilient extensions or flexible members which serve as the mixing extensions or paddles of the present stirring rod to cause agitation of material. The bending or flexible nature of the material defining flexible members line 20 is very important for having sufficient "paddle" length in material being stirred while providing for the insertion of the stirrer end through a small opening such as 1 inch diameter hole in a container lid, however, while the resilient aspect is highly desirable for reasons pertaining to assured proper lateral extension and position of lines 20 within material to be mixed, and for aiding to prevent tangling of the lines 20, centrifugal force under high speed rotation does throw the lines 20 outward from the axis of rod 12, thus resiliency may not always be absolutely required in lines 20.

Holes 16, at least the holes 16 nearest the second end (bottom) of rod 12 are preferably positioned at an angle or slope relative to the major length of rod 12 as can be seen in broken lines in FIG. 3, where the holes 16 are tilted relative to the lengthwise axis of rod 12. A simple procedure to acquire the angle of holes 16 is to apply a slight bend in the second or bottom end of rod 12 at point 18 so that the lower most end of the rod 12 (widened area 14) having holes 16 therethrough is angled relative to the main length of rod 12 as shown in FIGS. 3 and 4. Drilling or otherwise forming holes 16 at an angle absent the rod being bent is also suitable. Holes 16 at or adjacent the bottom terminal end of rod 12 are quite near the end of the rod as can be seen in the drawings, and by bending the rod end, for example at the upper portion of the flattened area 14 at point 18 above the top hole 16, the holes 16 on one side of rod 12 aim downward toward the container 22 bottom 24, and on the other side of the rod aim somewhat upward toward the first rod end such as toward the container lid as can be seen in FIG. 4. Angling holes 16 as herein described causes the line 20 within the holes to project from one side of the rod 12 downward toward the container 22 bottom 24 with the line 20 projecting upward further into the material being mixed on the other side of the rod 12. The downward projection of the line 20 positions the line extending below the adjacent terminal end of the second end or second end area of rod 12 as can be seen in FIG. 4, and this allows the line 20 during rotation of rod 12 to scrape the bottom 24 of the container 22. The upward extension of lines 20 on the opposite side of rod 12 allow the ready scraping or mixing directly against the underside of a container lid. With many materials, and especially with paints containing pigments which settle to the bottom with time, it is very important to scrape and stir-up the materials on the bottom of a container. Line 20 can be of various lengths outward from rod 12 within the scope of the invention, such as 3 to 9 inches on one side for example only, and since rod 12 is small in diameter it can be angled back and forth, and moved around by the human or mechanical operator to bring the rotating line 20 into all of the corner areas at the bottom of the container, and to further ensure adequate mixing, the operator (or some automated mixer or blender) can pull the stirring rod upward from the bottom into the middle of the material 28 and into the top or upper area during mixing. The rotating line 20 can be brought up into contact with the underside of a lid or container top having a bunghole or like opening to scrape the lid underside and mix the top layers of material 28, and due to the preferred physical characteristics of line 20, line 20 will not cut into or otherwise damage a container or lid, nor will it normally cut or otherwise seriously injure a person's hands or fingers coming into contact with the rotating line 20. Furthermore, because line 20 is flexible, rod 12 with attached line 20 can be inserted and withdrawn through a small hole or bunghole 26 (see FIGS. 1 and 4) wherein the line 20 folds during passage through the hole 26 and then due to its preferred inherent resiliency, line 20 springs back outward to a length substantially greater than the diameter of the hole 26 and rod 12. This allows in effect a large mixing paddle to be inserted through a small hole which is beneficial in many applications.

FIG. 7 shows a second or bottom end of a stirrer rod in accordance with the present invention and slightly varied, i.e., absent bottom flattened area 14, from that embodiment of FIGS. 2 and 3. The flexible stirring extension material (line 20) of FIG. 6 is shown inserted through holes 16 in the second end of rod 12. The holes 16 in this example are drilled or otherwise formed at an angle or tilt relative to the lengthwise axis of rod 12 in order to aim line 20 on one side of rod 12 downward beyond the second end terminal end of rod 12 for use in scraping bottoms of containers, and there has been no bending or flattening of rod 12 in this example. The pair of holes 16 can extend parallel to one another through the material of rod 12, or they each can be at slightly different angles relative to rod 12 and non-parallel to one another, although I have not found any significant reason for not having the holes 16 parallel to one another. The FIG. 7 rod 12 is shown cylindrical or round, and it could also be a hexagonal rod, i.e., hexagonal its entire length, and whether round or hexagonal it can be feasibly made of metal, wood, plastics or composites such as fiberglass. Rod 12 could be square stock or square bar within the scope of the invention, but square is less preferred because the corners may extend sufficiently that during rotation of the rod if the user's hand or fingers contact the rotating rod, it slaps the hand or fingers sufficiently to cause pain. In all embodiments using angled holes 16 to create an angled exit of line 20 from rod 12, it is the annular sidewall defining the hole 16 against which the line 20 abuts and is in effect forced to follow, and therefore a sidewall angled relative to the lengthwise axis of rod 12 and abutted against a retained line 20 could conceivably be a small diameter tube or tube portion inserted through or into a non-angle hole 16 with the tube extending outward slightly at least beyond one side of rod 12, with the tube bent or otherwise angled slightly downward, wherein with insertion of line 20 through the tube, an exit path of the line 20 from the tube would be downward, and this arrangement would also be considered within the scope of the invention. A non-angled exit path, while clearly not preferred, would be functional to a degree. A fitting, permanently or removably attached to the second end of the rod 12 and including structuring for holding line 20 would also be within the scope of the invention, as would a fitting permanently or removably attached to the first or top end of rod 12 such as might be used for adapting the end to different rotary drives.

It should be appreciated that the present stirrer or stirring rod can be manufactured inexpensively, can be readily disassembled for cleaning or repair, and is safe to use. Line 20 can simply be grasped in hand and pulled from the receiving holes 16 when desired such as for cleaning or replacement. Additionally, I have found the stirring rod as above described in various preferred embodiments for example to be a highly effective stirring rod for mixing and blending, particularly when mixing relatively thin liquids or fine powders. Furthermore, in most cases, a stirrer in accordance with the present invention can be manufactured very inexpensively, and at the time of this writing for under one U.S. dollar each, and this cost could be substantially reduced with mass production.

Although I have very specifically described preferred structures of the invention, it should be understood that the specific details are given for example. Changes in the specific structures described can be made without departing from the scope of the invention. One such change could be the injection molding or the like of plastics to form both rod 12 and extending line 20 as a single integrally formed structure. Therefore it should be understood that the scope of the invention is not to be overly limited by the specification and drawings given for example, but is to be determined by the broadest possible reasonable interpretation of the appended claims.

I claim:

1. A stirrer for use in mixing material, comprising;

an elongate main rod having a lengthwise axis;

said main rod having a first end area and a second end area, said first end area structured for connection to a rotary drive for axially rotating said main rod;

elongate flexible members comprising flexible and resilient plastics; said flexible members connected to said main rod in said second end area and extending outward from said main rod relative to the lengthwise axis of said main rod, the connection of said flexible members including said flexible members residing in-part within transverse holes through said main rod, said transverse holes each having a diameter smaller than a cross sectional width of said flexible members residing within said transverse holes; said flexible members positioned extending outward from each of two opposite sides of said main rod, the outward extension of said flexible members on a first side of the opposite sides of said main rod angling and extending beyond a terminal end of said second end area of said main rod.

2. A stirrer for use in mixing material in accordance with claim 1 wherein said flexible members are non-round in cross sectional width, and said transverse holes are round holes.

3. A stirrer for use in mixing material in accordance with claim 2 wherein said transverse holes extend at a non-perpendicular angle relative to the lengthwise axis of said main rod, and said first end area of said main rod suitably structured for connection to a rotary drive includes said first end area sized sufficiently small in cross sectional width for insertion into a chuck of a hand holdable drill type motor;

said main rod is of generally stiff construction, and said flexible members are defined by a single length of said flexible and resilient plastics folded in two and inserted into at least two of said transverse holes.

4. A stirrer for use in mixing material, comprising;

an elongate main rod having a lengthwise axis;

a first end area of said main rod, said first end area suitably structured for connection to a rotary drive for axially rotating said main rod;

a second end area of said main rod, said second end area oppositely disposed from said first end area;

at least one elongate flexible member comprising flexible and resilient plastics; said flexible member connected to said main rod in said second end area and extending outward from said main rod relative to the lengthwise axis of said main rod; the connection of said flexible member to said main rod including said flexible member in-part residing within a transverse hole through said main rod, said transverse hole having a diameter smaller than a cross sectional width of said flexible member residing within said transverse hole, the connection of said flexible member to said main rod such that axial rotation of said main rod rotates said flexible member.

5. A stirrer for use in mixing material in accordance with claim 4 wherein said flexible member is non-round in cross sectional width.

6. A stirrer for use in mixing material in accordance with claim 5 wherein said transverse hole is a round hole.

7. A stirrer for use in mixing material in accordance with claim 6 wherein said transverse hole extends at a non-perpendicular angle relative to the lengthwise axis of said main rod.

8. A stirrer for use in mixing material in accordance with claim 7 wherein said flexible member extends outward from each of two opposite sides of said main rod, the outward extension of said flexible member on a first side of the opposite sides of said main rod angling and extending beyond a terminal end of said second end area of said main rod.

9. A stirrer for use in mixing material in accordance with claim 8 wherein the outward extension of said flexible member on a second side of the opposite sides of said main rod is angling and extending slightly upward toward said first end area of said main rod.

10. A stirrer for use in mixing material in accordance with claim 9 wherein said first end area of said main rod suitably structured for connection to a rotary drive includes said first end area sized sufficiently small in cross sectional width for insertion into a chuck of a hand holdable drill type motor, and said main rod is of generally stiff construction.

11. A stirrer for use in mixing material, comprising;

an elongate main rod having a lengthwise axis;

a first end area of said main rod, said first end area suitably structured for connection to a rotary drive for axially rotating said main rod;

a second end area of said main rod, said second end area oppositely disposed from said first end area;

elongate flexible members comprising flexible and resilient plastics material readily bendable by hand;

said flexible members connected to said main rod in said second end area and extending outward from said main rod relative to the lengthwise axis of said main rod, the connection of said flexible members to said main rod including said flexible members residing in-part within transverse holes through said main rod, said transverse holes each having a diameter smaller than a cross sectional width of said flexible members residing within said transverse holes.

12. A stirrer for use in mixing material in accordance with claim 11 wherein said flexible members are non-round in cross sectional width, and said transverse holes are round holes.

13. A stirrer for use in mixing material in accordance with claim 12 wherein said transverse holes extend at a non-perpendicular angle relative to the lengthwise axis of said main rod, and said flexible members extend outward from each of two opposite sides of said main rod, the outward extension of said flexible members on a first side of the opposite sides of said main rod angling and extending beyond a terminal end of said second end area of said main rod.

14. A stirrer for use in mixing material in accordance with claim 13 wherein the outward extension of said flexible members on a second side of the opposite sides of said main rod is angling and extending slightly upward toward said first end area of said main rod.

15. A stirrer for use in mixing material in accordance with claim 14 wherein said first end area of said main rod suitably structured for connection to a rotary drive includes said first end area sized sufficiently small in cross sectional width for insertion into a chuck of a hand holdable drill type motor;

said main rod is of generally stiff construction, and said flexible members are defined by a single length of said flexible and resilient plastics folded in two and inserted into at least two of said transverse holes.

* * * * *